United States Patent [19]

Mims et al.

[11] Patent Number: 4,508,172

[45] Date of Patent: Apr. 2, 1985

[54] TAR SAND PRODUCTION USING THERMAL STIMULATION

[75] Inventors: Donald S. Mims; Richard S. Allen, both of Houston, Tex.

[73] Assignee: Texaco Inc., White Plains, N.Y.

[21] Appl. No.: 492,865

[22] Filed: May 9, 1983

[51] Int. Cl.[3] ..... E21B 43/24

[52] U.S. Cl. ..... 166/303; 166/306; 166/50; 166/57; 166/180

[58] Field of Search ..... 166/50, 57, 157, 180, 166/187, 191, 302, 303, 306

[56] References Cited

U.S. PATENT DOCUMENTS

| | | | |
|---|---|---|---|
| 4,026,359 | 5/1977 | Closmann | 166/306 |
| 4,116,275 | 9/1978 | Butler et al. | 166/303 |
| 4,362,213 | 12/1982 | Tabor | 166/306 |
| 4,368,781 | 1/1983 | Anderson | 166/272 |

*Primary Examiner*—Stephen J. Novosad
*Assistant Examiner*—William P. Neuder
*Attorney, Agent, or Firm*—Robert A. Kulason; Robert B. Burns

[57] ABSTRACT

Method and apparatus for recovering hydrocarbons from a subterranean formation in which a well completion, including a well liner, lies in a generally horizontal disposition within the hydrocarbon producing layer. The liner encloses conduit means for delivering a stream of a hot stimulating agent to the well's remote or injection end, and means for regulating the production of bitumen emulsion from the production end. A fluid impervious barrier is carried on and depends from the conductor means and forms a transverse fluid barrier within the liner. The conductor member is fixed within the liner whereby to serve as a means for introducing the thermal stimulating agent or medium to the substrate as well as functioning as a guide for the movable fluid impervious barrier. By adjusting the longitudinal position of said barrier, the hot stimulating agent is more effectively introduced to the substrate to improve the sweeping action thereof.

4 Claims, 3 Drawing Figures

TAR SAND PRODUCTION USING THERMAL STIMULATION

BACKGROUND OF THE INVENTION

In the production of viscous hydrocarbons such as heavy crude, or bitumen from tar sands, it is necessary to thermally stimulate the relatively viscous hydrocarbon material such that it can flow and be withdrawn from the substrate as an emulsion. Usually, thermal stimulation comprises the introduction of hot aqueous heating mediums such as pressurized steam, into the substrate by way of an injection well to contact the bitumen.

This stimulating step over a period of time fluidizes the bitumen and releases it from the tar sand. The steam also establishes a pressure front whereby to urge the now flowable hydrocarbon emulsion or mixture toward one or more production wells.

The present method and apparatus are applicable to producing either bitumen from tar sands, or heavy viscous crude oil from a reservoir thereof within the substrate. To simplify the following description, only bitumen will be referred to as the produced material.

Since the hot steam will condense under proper conditions, the product formed by the bitumen comprises in essence an aqueous mixture. Although this said product could be considered as being an emulsion, depending on the condition thereof, it will be hereafter referred to as an aqueous bitumen mixture.

In one method adapted to this type of viscous hydrocarbon production, it is found practical to utilize a single well which is sequentially heated and produced on the cyclical principle. More specifically, the environment around the well is initially preheated to put the bitumen into a flowable state. Thus, during a soak period, heat is absorbed into the substrate about the well causing the hot flowable material to gravitate toward the well. Thereafter, the stimulating step is continued in such manner that the hot mixture will continue to flow and to be produced from the well.

When over a period of time, pressure within the substrate deteriorates or the production flow decreases, it is necessary to recommence the cycle by further introduction of stimulating medium. As a sufficiently high pressure is reestablished and the bitumen solution is again caused to flow, steam injection is discontinued or minimized. Further controlled draw-down of the bitumen mixture can now be resumed.

This cyclical process can be continued indefinitely until the substrate adjacent to the well becomes exhausted of producible hydrocarbon product. Because of its general character, the method is referred to generally as the huff and puff process. It is found to function efficiently particularly when the stimulating medium is steam.

In an alternate method for producing viscous hydrocarbons from this type of substrate, a plurality of generally vertical wells are drilled in a desired surface pattern. Thereafter, a stimulating fluid such as steam is injected over a period of time into the substrate through a centrally located injector well.

The heated or stimulated area about the well will be progressively widened, thereby establishing a pressure front which drives flowable bitumen mixture toward the surrounding producing wells.

This process enjoys the advantage of being practiced by the continuous introduction of the hot stimulating medium. It thus yields a continuous out- flow.

It is found desirable toward achieving an improved bitumen production rate, to utilize a generally horizontally disposed well for producing from a relatively thin hydrocarbon containing layer. Due to the nature of this type of well, the latter must as herein noted operate on a cyclical basis to achieve an appreciable outflow of bitumen mixture. Since cyclical operation amounts to a disruption of the producing phase it constitutes a less than economical expedient.

To realize an improved production rate from a horizontal well of the type contemplated, there is presently provided an efficient method and apparatus for producing a hot aqueous bitumen mixture from a tar sand or similar environment. The process is effectuated through a single, elongated horizontal well which lies in at least a portion of a tar sand layer, preferably in a direction concurrent with the layer's direction.

Both the horizontal well itself and the adjacent substrate, are initially preheated to establish a favorable operating temperature at which fluidized bitumen mixture becomes mobile. The well includes means to establish a pattern of paths through the productive layer along which the bitumen mixture will readily flow. Said paths thereby communicate a relatively high pressure injection area where the stimulating fluid is introduced, with the low pressure area in the well toward which the bitumen gravitates.

Thereafter, and subsequent to the preheating step, the horizontal well is produced by regulated further introduction of hot stimulating fluid. This latter injection, together with control of the well back pressure, causes fluidized bitumen mixture to be urged toward the well producing end. At high temperature conditions, and after a period of operation, all or a part of the stimulating steam will be produced with the mixture, thereby giving an indication of a decrease in the production rate.

To maintain a favorable production output, the substrate is most effectively swept clean of removable bitumen by adjusting the injection pattern of stimulating fluid. The latter is achieved by diverting the flow of the stimulating steam whereby to change the relationship between the high pressure or injection under the well liner, and the low pressure or production end thereof.

It is therefore an object of the invention to provide a method and apparatus for improving the production of viscous hydrocarbon fluid from the subterranean reservoir in which the hydrocarbon fluid is locked. A further object is to provide a method and apparatus for stimulating and producing a well aligned substantially horizontally in the formation, and containing a relatively viscous hydrocarbon. A still further object is to provide a method and apparatus for the continuous production of a viscous hydrocarbon fluid from a single well disposed substantially horizontally through a productive formation.

Figure 1:
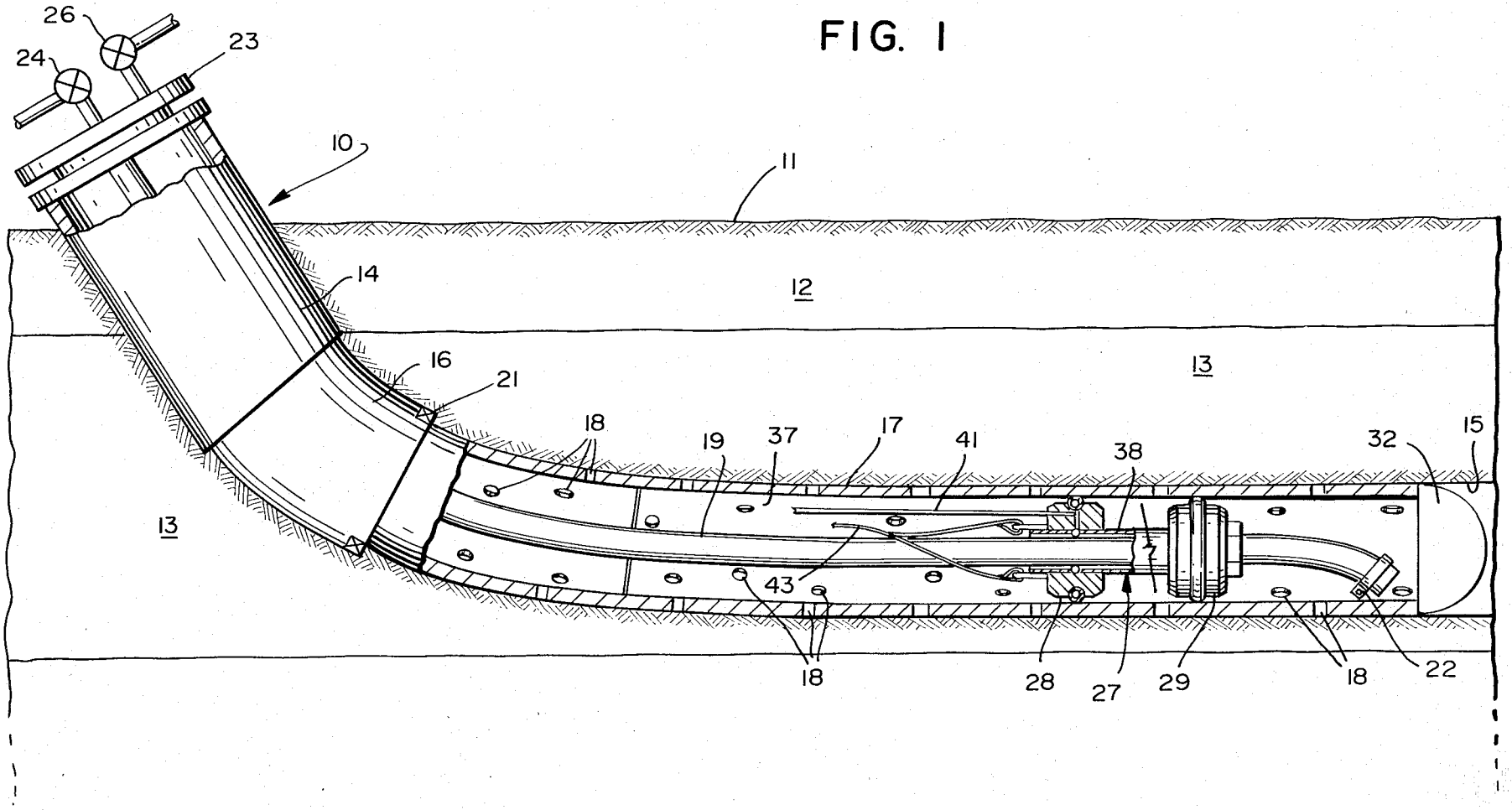
FIG. 1 is an elevation view in cross-section of a horizontal well of the type contemplated.

Referring to the drawings, well 10 of the type contemplated is shown which enters the ground vertically, or preferably at an angle to the surface 11. Wellbore 15 is initially started through overburden 12 which overlies the productive or tar sand layer 13.

Thereafter, partway through overburden layer 12, bore 15 is deviated in the manner that at least a segment of the bore lies in a generally horizontal relationship with respect to layer 13 as well as to the earth's surface 11. Further, the well's horizontal segment is preferably positioned to the depth whereby to be adjacent to the lower border of the generally horizontal, hydrocarbon containing layer 13. Following the usual drilling practices, wellbore 15 is provided at its upper end with a series of casing lengths 14 and 16 which are fixed in place.

An elongated liner 17 is inserted through the respective casings 14 and 16, and is supported in casing 16 by a liner hanger 21. The latter is structured to permit passage of bitumen emulsion, or hot stimulating fluid therethrough during the producing or injecting stages of the operation. Liner 17 can be provided at its forward or remote end with a bull nose 32 or similar means to facilitate its being slidably inserted into the wellbore.

Structurally, liner 17 comprises a steel, pipe-like member being perforated as required along that portion of the wall which lies within the tar sand layer 13. The perforations 18 can take the form of a series of holes in the liner wall. Alternately they can comprise slotted openings which extend either longitudinally or peripherally about the liner. Further, said perforations, if in the form of holes, can be formed either before or after the liner is set within the bore 15.

In any event, liner openings 18 are adequate to allow the discharge of heating medium therethrough and into the adjacent tar sand substrate 13. Further, they allow the return flow or the entry of a hot aqueous bitumen mixture through the same wall openings after said mixture achieves a flowable state.

An elongated fluid carrying conductor 19 is disposed internally of liner 17. Conductor 19 when fully inserted, rests on the liner wall. Said conductor is constructed preferably of continuous tubing, connected pipe, or the like.

Conductor 19 is capable of carrying a pressurized (about 200 to 500 psi) stream of hot stimulating fluid such as steam, hot water, or either of said elements having appropriate chemicals intermixed therewith to facilitate the producing step. The composition of the injected fluid will depend to a large extent on the particular conditions encountered in the substrate being stimulated. Operationally, conductor 19 not only carries the stimulating fluid but also functions as a guide member as will be hereinafter noted.

The upper external ends of the respective liner 17 and conductor 19, are provided with a closure means 23 such as a well head. The latter includes valves 24 and 26 which are operable to permit selective and controlled communication of the individual liner passages with a source of the pressurized stimulating fluid.

Conductor 19 by and large rests on the lower wall of liner 17. However, to facilitate its function as a guide member, the remote end of the conductor which is disposed adjacent to the remote end of the liner, is fastened in place with a suitable bracket 22 depending from the inner wall of liner 17.

A fluid diverter 27 means is operably positioned within liner 17 and slidably carried on the outer surface of conductor 19. One embodiment of flow diverter means 27, as shown in FIG. 1, comprises one or more packers 28 and 29, or similar form of apparatus often used in downhole operations and which are selectively actuatable to releasably engage adjacent liner walls.

Figure 2:
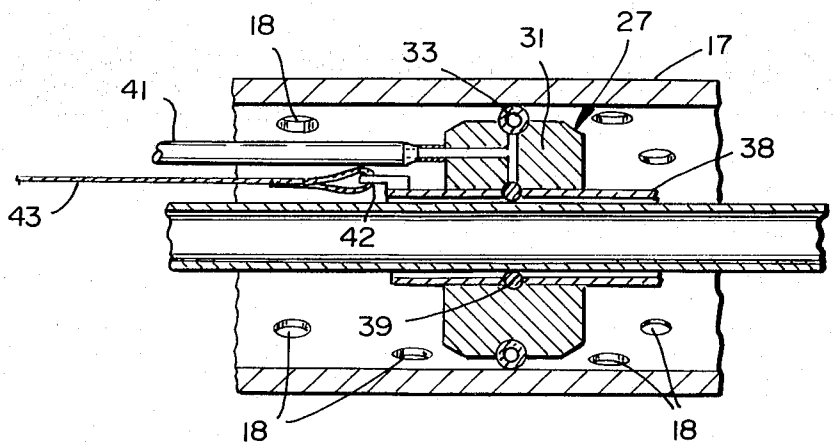
FIG. 2 is an enlarged segmentary view in cross-section of a portion of FIG. 1.

Referring to FIG. 2, a packer of the type contemplated includes in essence a body 31 having a diameter which is less than the internal diameter of liner 17. The outer edge periphery of said body 31 is provided with a peripheral groove which retains an inflatable, expandable annular member 33 therein.

In the deflated condition, said inflatable member is contracted to the extent that the packer is spaced from the liner 17 inner wall. It can thus be readily moved longitudinally through the liner. In the expanded condition, however, inflatable member 33 will engage the adjacent walls of liner 17 thereby firmly positioning the packer member. It will concurrently form a fluid tight annular seal which in effect segregates the liner length into an injection segment 36, and a production segment 37.

Packer body 31 is provided with a central passage or opening which is of sufficient size to slidably register along conductor 19 outer surface. Preferably, said central opening can be provided with a cylindrical sleeve 38 or the like. The latter registers about the conductor outer surface to facilitate the slidable movement of the packer unit along conductor 19 as will be hereinafter noted.

To facilitate the sealing function of packer 28, body 31 can be provided with an inner, inflatable ring 39. The latter is communicated with the outer expandable member 33. Both said members are in turn communicated through external connection which engages elongated flexible conduit 41. The latter extends to well head 23 and can thus be communicated with a source of a pressurized actuating fluid.

Operationally, flow diverter 27 is rigidly fixed at a desired location, by introducing pressurized actuating medium into both the expandable member 33 and the central inflatable ring 39. Said members thus form annular concentric fluid tight seals within liner 17, thereby defining a fluid tight transverse barrier therein. Further, from an operational consideration, the expanded diverter as noted segregates the length of liner 17 into two distinct parts, i.e. the remote or injection segment 36 and the production segment 37.

The forward end of the fluid diverter 27 is provided with connector means 42 such as a ring, shackle or the like which is adapted to engage a pulling mechanism. The latter can comprise an elongated cable 43 which connects to the ring at one or more peripherally spaced points. Cable 43 is of sufficient length to reach well head 23 whereby to be reeled in to draw the packer member longitudinally through liner 17.

In one embodiment of the fluid diverter 27, the latter can comprise as shown in FIG. 1, a plurality of tandemly mounted packer members 28 and 29. The latter are carried on a common central mounting element 44. Said element serves as a bearing surface or sleeve which slidably engages the outer wall of conductor 19. In this embodiment, each of the respective packers includes inner and outer inflatable members such as 33 and 39, all of which are manifolded to fluid actuating conduit 41. Thus, the tandem packers can be actuated simultaneously into either their expanded or contracted state.

Under normal bitumen emulsion producing conditions, the entire well 10 will be put into operating condition by preheating the well 10, as well as by penetrating the substrate adjacent thereto with the hot stimulating medium. In such an instance, steam is introduced to substrate 13 by way of the production segment 37. Thus, the flow of steam through conductor 19 is received from a source thereof and regulated at valve 24. A second flow of heating steam is introduced by way of well head 23 and valve 26 to the producing segment 36 of liner 17 which terminates at diverter 27.

The initial preheating or soaking phase of a producing operation can consume several weeks depending on the length of the well through the substrate, and the efficiency of the heat transfer facility.

During this soak period, hot pressurized steam will flow from all parts of liner 17 and penetrate the layer 13. In that the hot steam is under pressure it will tend to move upwardly through substrate 13, thereby progressively liquefying the bitumen, causing it to intermix with the steam condensate thereby forming a hot bitumen emulsion.

To commence the actual producing operation, the flow of stimulating steam through valve 26 and to the production end 37 of the liner 17 is discontinued. However the introduction of stimulating heat to central conductor 19 is continued such that the steam will enter the injection segment 36 of liner 17 and continue to be passed outwardly and into substrate 13.

Due to the pressure differential in liner 17 across the diverter member 27, the steam will tend not only to gravitate upwardly, but will also tend to move from the higher pressure segment 36 of the liner, toward the lower pressured production segment 37.

Figure 3:
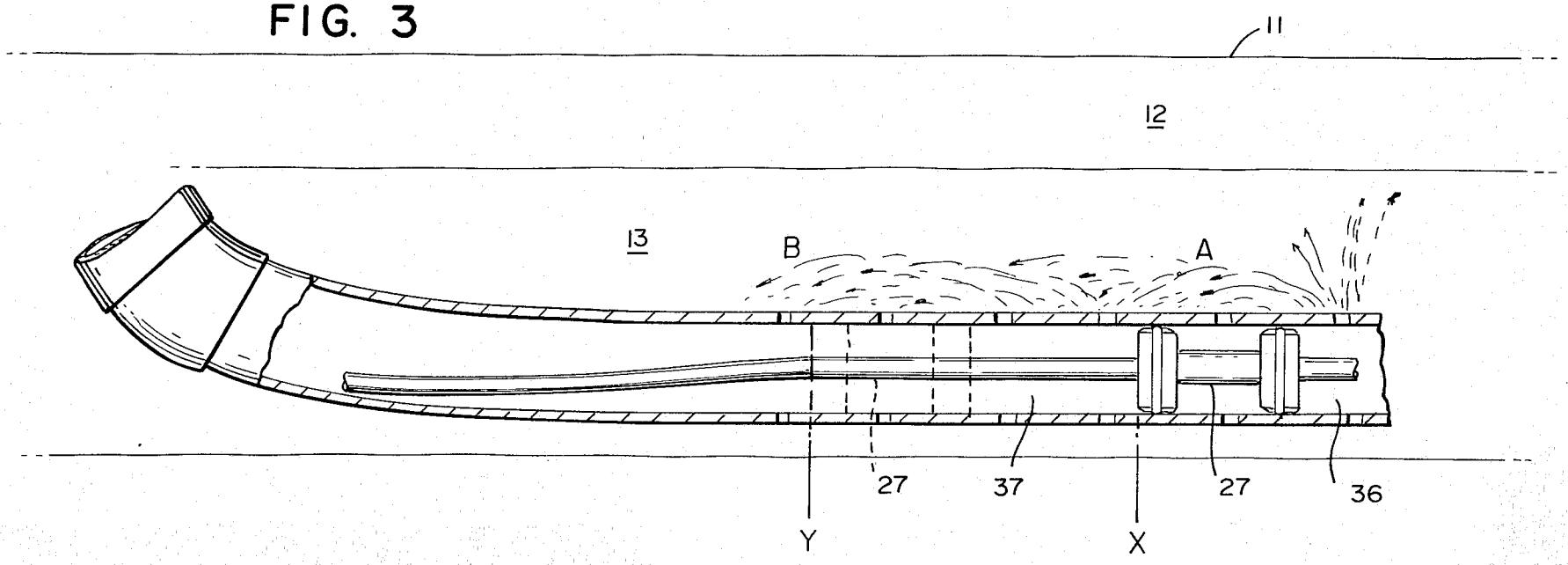
FIG. 3 is a schematic representation of the well shown in FIG. 1.

Referring to FIG. 3, as the bitumen is progressively melted the resulting emulsion will enter the perforations 18 thereby establishing a pattern of flow paths identified collectively as A, through tar sand layer 13. This pattern is formed by the flowing bitumen emulsion as the latter seeks the lower pressure end of the liner producing segment 37.

Accumulated bitumen emulsion within liner 17 can be removed therefrom by gravity flow, by pumping or by other suitable means. In either instance, production outflow will continue until it becomes evident from the volume produced at well head 23, and from the amount of steam produced concurrently therewith, that the thermally treated subterranean area of layer 13 has been depleted of bitumen.

To revive the bitumen flow at well head 23, it is necessary to adjust the flow path pattern A by extending the individual flow paths into areas that had been preheated but are not producing.

Again referring to FIG. 3, this adjustment is achieved by withdrawing flow diverter 27 from its initial position at location X within liner 17, and further into the producing segment 37 to a location Y, closer to well head 23.

With diverter 27 in the new position, hot stimulating fluid is again introduced through conductor 19. Pressurized steam will continue to pass outwardly into the substrate 13. However, the steam will also enter the enlarged or extended injection segment 36 of liner 17 which has been formed as the result of diverter 27 being repositioned further into segment 37.

As hot stimulating fluid continues to penetrate tar sand layer 13, it will establish new set of flow paths identified collectively as B. These paths are established in heretofore unproduced sections of the said layer as the bitumen emulsion again gravitates toward the lower pressured producing segment 37 of the liner. These new flow paths A, will constitute not only an extension of the old flow paths, but will also result in an extension of the entire flow pattern.

In this new position of diverter 27 at Y, producing of the bitumen emulsion is continued until as herein noted, a decrease will become evident in the volume produced at the well head 23, together with greater amounts of steam being discharged concurrently therewith.

Over a period of time, the diverter 27 will be progressively moved in incremental steps toward the well head 23 until such time as the diverter has passed through the liner 17 and is at the upper limit of the tar sand layer 13.

At this point in the operation, the tar sand layer will have been completely thermally treated and consequently will have been drained of available bitumen.

Although modifications and variations of the invention can be made without departing from the spirit and scope thereof, only such limitations should be imposed as are indicated in the appended claims.

We claim:

1. Well completion for producing bitumen emulsion from a subterranean tar sand layer in which the bitumen is releasably held, which completion includes:

an elongated, perforated liner which is disposed in a wellbore, the latter being in substantial horizontal alignment with respect to the tar sand layer having an upper end, and terminating at a remote injection end, a conductor extending longitudinally of said liner having at least one discharge port adjacent to the liner remote end, and communicated at the other end to a pressurized source of a hot stimulating fluid whereby said fluid can be conducted through said conductor and injected into the substrate adjacent to said liner, a well head at the upper end of the respective liner and the conductor, flow diverter means within said liner operably registered in the conductor to be moved longitudinally therealong, said flow diverter means being actuable to engage the liner walls and form an annular seal thereby to segregate the liner into discrete injection and producing segments respectively, means for displacing said flow diverter through said liner whereby to concurrently adjust the length of the respective injection and producing segments, and a conductor positioning bracket engaging said conductor and liner respectively, to fixedly position the conductor at the liner remote injection end.

2. Well completion as defined in claim 1, wherein said means for displacing the flow diverter includes a cable means which is attached to the diverter means and extends to said well head.

3. Well completion as defined in claim 1, wherein said flow diverter means includes; a body having an axial-passage extending therethrough, said conductor being registerable within said axialpassage to be slideably positioned thereon, and being operable to form a fluid tight seal with the conductor wall.

4. Well completion as defined in claim 3, wherein said flow diverter includes; a plurality of longitudinally spaced apart bodies and a common sleeve supporting the respective bodies to permit sliding movement thereof along said conductor.

* * * * *